United States Patent [19]

Fry, Jr. et al.

[11] Patent Number: 4,842,550

[45] Date of Patent: Jun. 27, 1989

[54] INTEGRALLY MOLDED ENVIRONMENTALLY PROTECTED STRAIN RELIEF BACKSHELL

[75] Inventors: Rupert J. Fry, Jr., Des Plaines; Raymond A. Silbernagel, Naperville, both of Ill.

[73] Assignee: Molex Incorporated, Lisle, Ill.

[21] Appl. No.: 214,076

[22] Filed: Jul. 1, 1988

[51] Int. Cl.[4] ..... H01R 13/56; H01R 13/58

[52] U.S. Cl. ..... 439/471; 439/464

[58] Field of Search ..... 439/464, 465, 467, 470, 439/471

[56] References Cited

U.S. PATENT DOCUMENTS

| | | | |
|---|---|---|---|
| 3,874,765 | 4/1975 | Gilmore et al. | 439/464 |
| 3,889,909 | 6/1975 | Koscik | 439/471 X |
| 4,125,312 | 11/1978 | Aimar | 439/465 X |
| 4,280,746 | 7/1981 | Ignatowicz | 439/470 |
| 4,358,178 | 11/1982 | Guy | 439/464 |

*Primary Examiner*—Eugene F. Desmond

[57] ABSTRACT

A unitarily molded environmentally protective backshell is provided with a unitary ratcheted tie strap for strain relief connection of a cable to the backshell. The backshell comprises a base for receiving an electrical connector therein and a cover hingedly connected to the base for environmentally protecting the electrical connector therein. Resilient latches lockingly retain the cover to the base. The interengagement of the cover with the base prevents outward bowing of the base side walls. The ratcheted tie strap lockingly engages a deflectable ratchet trigger which also is unitary to the base. The trigger is angularly aligned to walls of a tie strap receiving aperture and is dimensioned to exert a biasing force against the tie strap thereby preventing loosening of the strain relief connection.

19 Claims, 5 Drawing Sheets

INTEGRALLY MOLDED ENVIRONMENTALLY PROTECTED STRAIN RELIEF BACKSHELL

BACKGROUND OF THE INVENTION

Panel mount connectors comprise a nonconductive housing with electrically conductive terminals securely mounted therein. Conductive leads from a discrete wire or cable are electrically connected to the terminals in the housing. The connector is configured to mate with a compatible connector on a panel or in a free hanging position within an electrical apparatus.

In many instances, the panel of the electrical apparatus may be in a somewhat uncontrolled environment. The typical panel mount connector provides little if any environmental protection such that their use in harsh environments would render the fragile and sensitive electrical terminations inoperative. Although environmentally protected electrical connectors are known, they tend to be complex multi-component structures that are relatively expensive.

Electrical connectors often are used in environments where frequent connection to the electrical apparatus and disconnection therefrom is likely. Although the connector housing and the terminals therein can be designed to accommodate frequent connection and disconnection, the connectors typically are not constructed to provide strain relief. Thus, forces exerted on the insulated leads external to the connector housing can damage the electrical connections within the housing.

Structures are known for use with electrical connectors to provide some degree of strain relief and to thereby prevent against damage due to forces exerted during the frequent connection and disconnection. Some such structures are known as backshells and surround the cable and/or connector. For example, one such backshell is shown in U.S. Pat. No. 4,125,312 which issued to Aimar on Nov. 14, 1978. The backshell shown in U.S. Pat. No. 4,125,312 includes a pair of hermaphroditic shells which can be engaged around an electrical connector. Each shell comprises a short tongue having arrays of ratchet teeth extending along opposed sides. The shells further include apertures having means for lockingly engaging such ratchet teeth. The tongues on each of the two identical shells are received in the apertures on the opposed shells as the shells are urged into a mated condition around the wires and the connector. Thus, the cooperating tongues and apertures may serve a dual function of holding the shells together and possibly achieving some degree of strain relief with respect to the wires extending into the connector. However, this construction prevents the tongues from being tightened relative to the opposed shell to increase or otherwise alter any strain relief that may be achieved by the backshell. Each shell shown in U.S. Pat. No. 4,125,312 further comprises a deflectable locking finger which engages the opposed shell. The assembled backshell structure of U.S. Pat. No. 4,125,312 defines a pair of apertures constructed to receive screws. The electrical connector is securely held in the backshell by screws extending through flanges on the connector and into the screw receiving apertures of the backshell. The backshell structure shown in U.S. Pat. No. 4,125,312 is considered undesirable in view of the complex plural components required and the poor strain relief that is achieved.

Another housing for an electrical connector backshell is shown in U.S. Pat. No. 4,358,178 which issued to Guy on Nov. 9, 1982. The backshell shown in U.S. Pat. No. 4,358,178 includes mateable housing halves which are engageable around an electrical connector. The rearward end of the backshell housing includes an aperture for receiving a multi-conductor insulated cable. Portions of the backshell housing on either side of the cable receiving portion comprise apertures for receiving a separate retcheted cable tie which can be securely received in the apertures of the housing and tightened around the cable to achieve a strain relief connection. Thus, the backshell housing shown in U.S. Pat. No. 4,358,178 also requires plural components and a separate strain relief means.

U.S. Pat. No. 4,341,431 issued to Woratyla on July 27, 1982, and also shows a multi-component backshell housing for enclosing a panel mount electrical connector. The backshell housing shown in U.S. Pat. No. 4,341,431 also includes an aperture adjacent the portion of the multi-component backshell housing through which the conductive leads extend. The aperture is dimensioned to receive a separate ratcheted cable tie which is operative to hold a plurality of insulated electrically conductive leads to the housing.

Other multi-component electrical connector backshell housings with separate strain relief means are shown in U.S. Pat. No. 4,327,956 which issued to Sitzler on May 4, 1982 and U.S. Pat. No. 4,606,596 which issued to Whiting et al on Aug. 19, 1986.

A one-piece housing intended to achieve strain relief is shown in U.S. Pat. No. 3,854,787 which issued on Dec. 17, 1984 to Snyder, Jr. The structure shown in U.S. Pat. No. 3,854,787 includes a pair of rearwardly extending generally planar surfaces which are disposed on opposite sides of an array of separately insulated conductors. These planar structures are secured to one another around the array of electrically conductive leads by separate bolts passing therethrough. This structure is substantially opened on all four sides and provides virtually no environmental protection. Furthermore, the use of separate bolts adds to costs, inventory problems and time required for mounting the housing about the connector. It is also believed that this structure would achieve very poor strain relief.

In view of the above, it is an object of the subject invention to provide an integrally molded housing for achieving strain relief engagement with an electrical connector.

It is a further object of the subject invention to provide a unitarily molded backshell structure that achieves a high degree of adjustable strain relief and that positively prevents loosening.

An additional object of the subject invention is to provide a unitarily molded backshell that environmentally protects the electrical connector.

A further object of the subject invention is to provide a backshell having an adjustable ratcheted strain relief tie that is unitarily molded with structure for securely locking the tie about the insulated conductive leads extending from an electrical connector.

Still an additional object of the subject invention is to provide a strain relief backshell that completely avoids inventory management problems.

SUMMARY OF THE INVENTION

The subject invention is directed to a molded backshell comprising a base and a cover hingedly connected to said base and rotatable into locking engagement therewith. The base, the cover and the hinge extending therebetween preferably are of unitary molded construction. The backshell further comprises an integrally molded ratcheted tie strap for strain relief attachment of at least one insulated lead to the backshell. A tie strap ratchet trigger also is integrally molded with the backshell such that the tie strap can be inserted through the ratchet trigger to be securely locked around the one or more insulated leads extending into the backshell. Thus, a secure adjustable strain relief connection of the cable to the backshell is provided without resorting to separate strain relief structures.

The molded base of the backshell may comprise a base wall and a plurality of upstanding side walls unitary therewith. The base wall and side walls may be substantially free of apertures that could otherwise permit liquids to enter the backshell enclosure. The backshell may further comprise an array of walls for engaging the mounting ears or flanges of a commercially available electrical connector, and preventing relative movement between the connector and the backshell once the cover is lockingly engaged over the molded backshell base.

The upstanding side walls of the molded base of the backshell may be provided with an externally disposed rabbet groove for engaging corresponding structure on the cover of the backshell. Interengagement of the rabbet groove on the side walls of the base with the corresponding structure on the cover contributes to the environmental protection of the connector. The rabbet groove on the externally disposed top portion of the side walls may further comprise a chamfered entry to facilitate alignment of the cover with the backshell.

External portions of the side walls of the base may comprise locking means for locking engagement with corresponding structures on the cover. In particular, the side walls may comprise ramped locking protrusions for engagement with the resiliently deflectable latches on the cover. The ramped locking protrusions may extend outwardly from external portions of the molded base side walls to achieve enhanced environmental sealing, as compared to known structures having internally disposed locking means.

The rearwardmost portion of the molded base of the backshell comprises a channel for receiving the cable, wire or other such lead extending from the backshell. The tie strap ratchet trigger is integrally molded with the base and disposed adjacent the cable receiving channel therein. More particularly, the tie strap ratchet trigger is cantilevered into an aperture for receiving the tie strap. The aperture may be provided with means for accurately guiding the tie strap into its proper position for locking engagement with the ratchet trigger. The tie strap ratchet trigger preferably is angularly cantilevered relative to the direction of movement of the tie strap through the aperture in the base as defined by the guide means of the aperture. The angular alignment of the tie strap ratchet trigger into the aperture achieves the desired deflectability of the ratchet trigger and enhances locking engagement with the ratchet teeth on the tie strap. Preferably, the ratchet trigger comprises a plurality of ratchets thereon to be interengaged with each of a plurality of ratchet teeth on the tie strap.

The tie strap is flexible and defines a length substantially greater than the length required to engage the cable extending into the backshell. Thus, the free end of the tie strap will extend through the aperture in the backshell base a significant distance beyond the ratchet trigger therein. As a result, the tie strap can be readily pulled to ensure secure adjustable retention about the cable or other such leads extending into the backshell. The insertion and tightening of the tie strap about the cable extending into the backshell can be performed either manually or by known locking guns which have been used with separate tie straps. The tie strap may comprise a pair of spaced apart longitudinal surfaces thereon with the ratchet teeth disposed intermediate the longitudinal surfaces and transverse thereto. The thickness of the strap may be selected in accordance with corresponding guide means adjacent the aperture into which the tie strap is inserted. The cooperation between the longitudinal surfaces on the tie strap and the guides adjacent the aperture in the backshell base substantially prevent overdeflection of the ratchet trigger that could otherwise damage or weaken the gripping power of the ratchet trigger after complete insertion of the tie strap.

The cover of the backshell is hingedly attached to the base by a flexible hinge which preferably is unitarily molded with both the base and the cover. The cover may be generally planar but may comprise a peripheral lip for engagement with portions of the side walls of the base. The peripheral lip may be chamfered to positively align the cover with the base. The cover further comprises a plurality of means for lockingly engaging the cover with the base. The locking means may comprise latches disposed to telescopingly extend externally over the side walls of the base and to lockingly engage ramped protrusions or other such structures on the base. The external disposition of the cover latches relative to the side walls of the base prevents external bowing of the base which could otherwise reduce the environmental protection.

DETAILED DESCRIPTION OF THE PREFERRED EMBODIMENT

Figure 1:
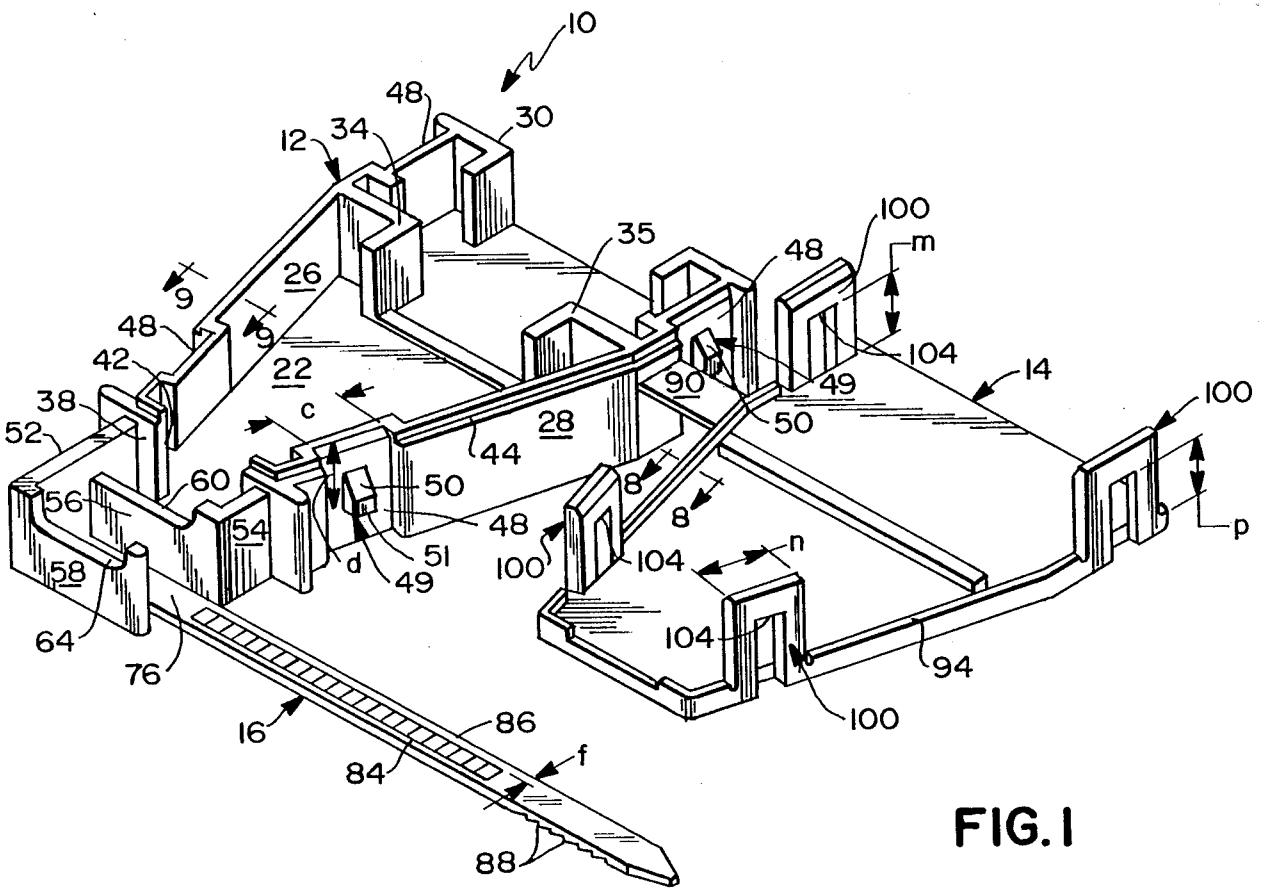
FIG. 1 is a perspective view of the backshell of the subject invention in an opened condition.

The molded backshell of the subject invention is identified generally by the numeral 10 in FIG. 1. The backshell 10 is of unitary molded plastic construction and comprises a base 12, a cover 14 and a tie strap 16. The backshell 10 is constructed to lockingly receive a commercially available electrical connector, identified generally by the numeral 18 in FIG. 2, such that the connector is substantially environmentally protected therein. The backshell 10 is further constructed to ensure a superior permanent strain relief connection to one or more cables 20 extending to the connector 18.

As shown most clearly in FIG. 1, the base 12 of the backshell 10 comprises a base wall 22 and upstanding side walls 26 and 28 extending unitarily from the base wall 22. The unitarily molded base 12 further comprises front walls 30 and 32 extending from and unitarily connected to both the base wall 22 and the upstanding side walls 26 and 28. As shown most clearly in FIG. 2, the front walls 30 and 32 function to properly align the mating end of the electrical connector 18 relative to the backshell 10. The base 12 of the backshell 10 further comprises a plurality of internal walls 34 and 35 which also function to align the connector 18 and securely retain the ears 36 and 37 of the connector 18 in the backshell 10 as shown most clearly in FIG. 2.

Figure 2:
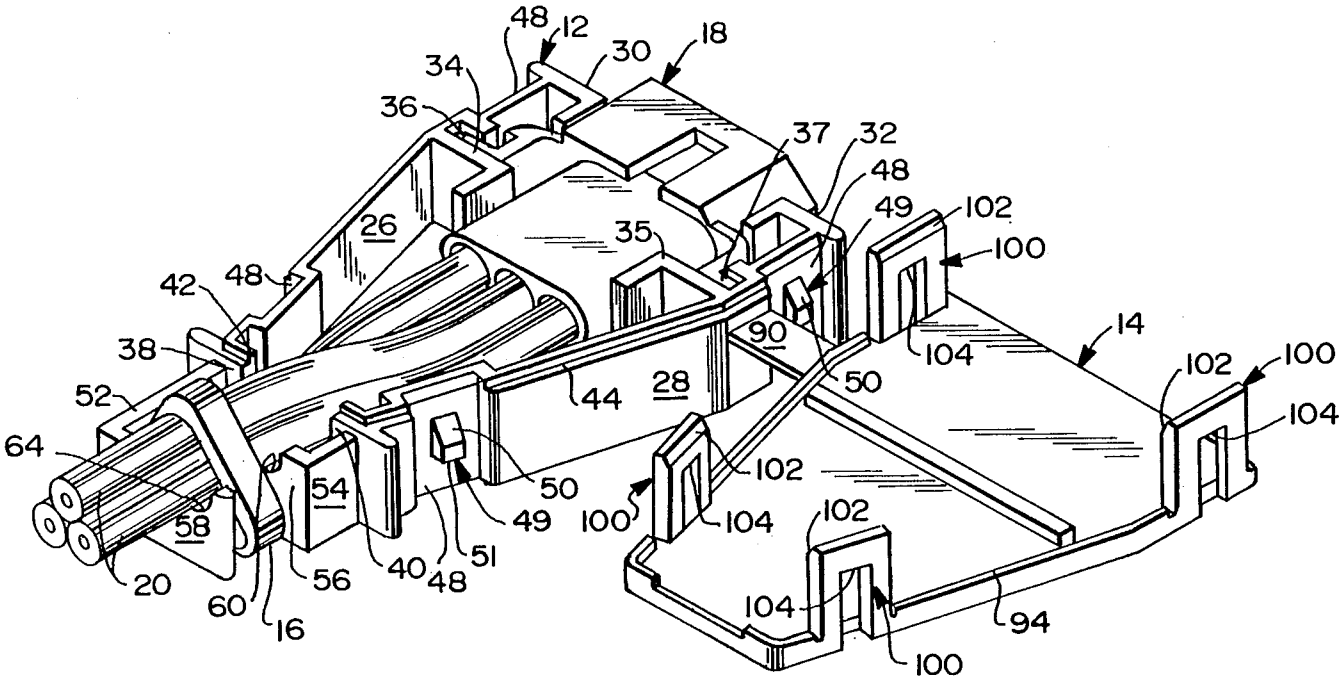
FIG. 2 is a perspective view of the backshell in an opened condition with an electrical connector mounted therein.

The base 12 of the backshell 10 is further provided with spaced apart rear walls 38 and 40 which extend unitarily from the base wall 22 and which are connected unitarily with the opposed side walls 26 and 28. The spaced configuration of the rear walls 38 and 40 defines a channel through which the array of cables 20 may extend as shown in FIG. 2.

Figure 9:
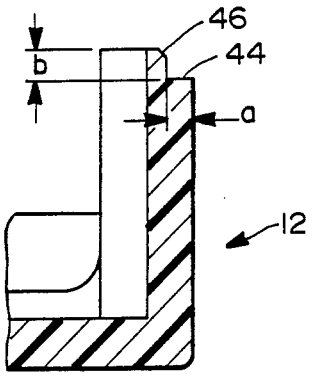
FIG. 9 is a cross-sectional view taken along line 9—9 in FIG. 1.

The portions of the side walls 26 and 28 and the rear walls 38 and 40 remote from the base wall 22 define an externally disposed rabbet groove 44 extending around the periphery of the base 12. The rabbet groove 44 is shown more clearly in FIG. 9 and includes a width "a" and a depth "b" which are dimensioned to receive a comparable structure on the cover 14 as explained further herein. Additionally, as shown most clearly in FIG. 9, the portions of the side walls 26 and 28 and the end walls 38 and 40 adjacent to the rabbet groove 44 define a chamfer 46 which facilitates alignment and proper seating of the cover 14 relative to the base 12.

The side walls 26 and 28 are provided with internally directed locking recesses 48 having a width "c". Each locking recess 48 is provided with a ramped locking protrusion 49 having a ramp 50 and a locking surface 51. The locking surface 51 is spaced from the top of the associated side wall 26, 28 by a distance "d". The locking protrusion 49 enable secure locking engagement with deflectable latch structures on the cover 14 as explained further below.

Figure 3:
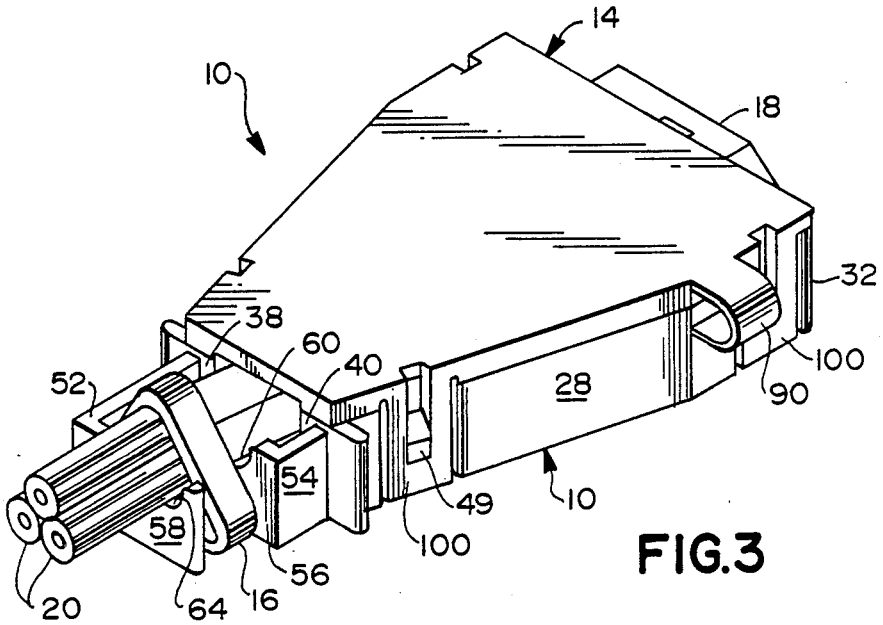
FIG. 3 is a perspective view of the backshell in a closed position with an electrical connector mounted therein.
Figure 4:
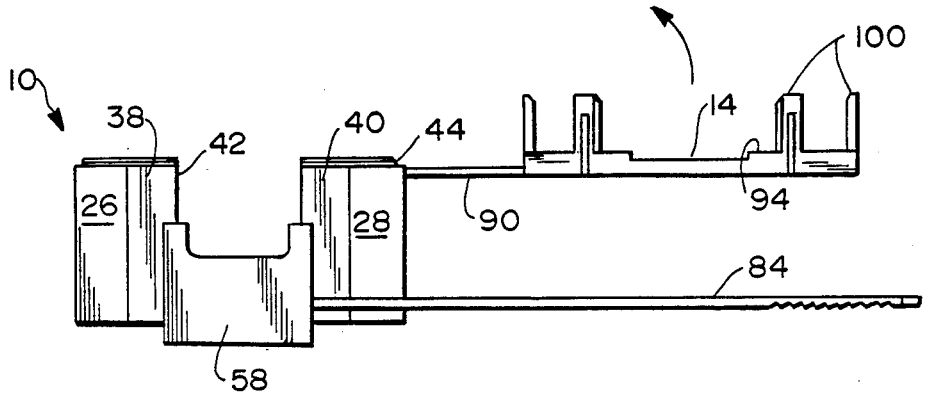
FIG. 4 is an end elevational view of the backshell in an opened condition.

The rear of the backshell base 12 comprises a rearwardly projecting strap guiding wall 52, a rearwardly projecting wall 54 and transversely extending cable support walls 56 and 58. More particularly, the transverse cable support wall 56 extends between and connects the walls 52 and 54. The cable support wall 56 is provided with a generally arcuate channel for receiving and supporting the array of cables 20 as shown in FIGS. 2 and 3. The transverse cable supporting wall 58 defines the rearwardmost portion of the base 12 and extends unitarily from the strap guiding wall 52. The transverse cable supporting wall 58 is further maintained in supporting position relative to the wall 56 by the strap support wall 62 as shown most clearly in FIGS. 6 and 7. Returning to FIGS. 1–3, the transverse wall 58 is provided with a cable receiving channel 64 for receiving and properly aligning the cables 20 prior to the strain relief connection of the tie strap 16 thereto.

Figure 6:
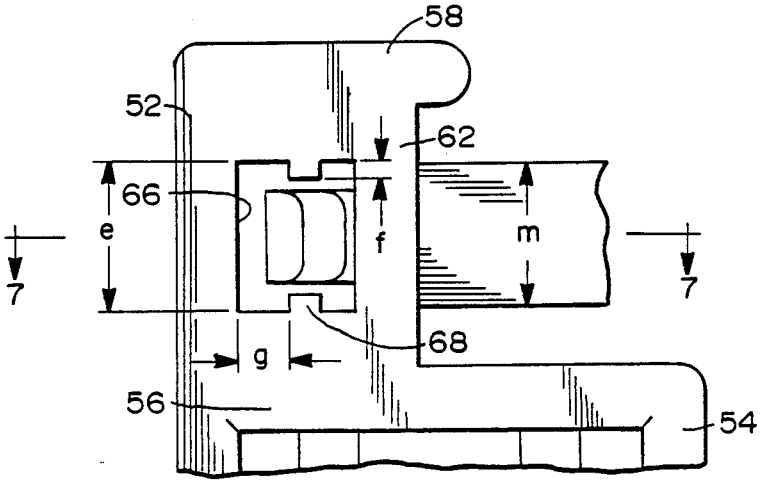
FIG. 6 is a bottom elevational view showing the ratchet trigger and tie strap of the backshell.
Figure 7:
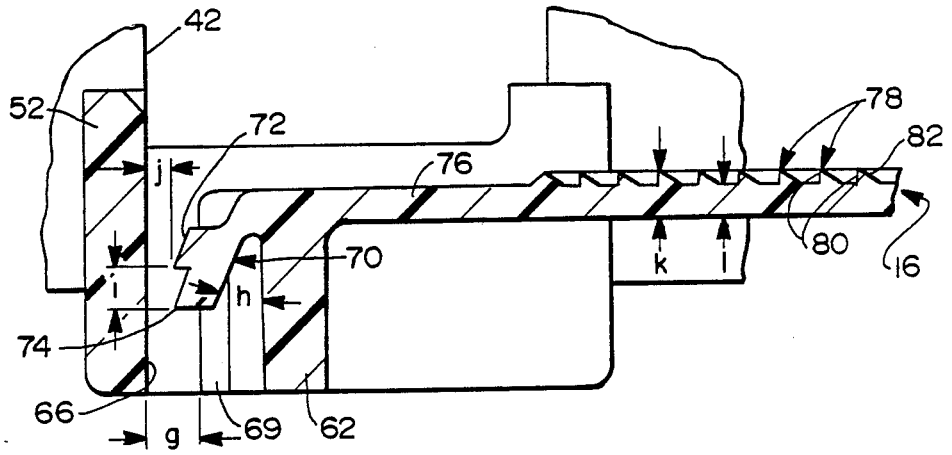
FIG. 7 is a cross-sectional view taken along line 7—7 in FIG. 6.

With reference to FIGS. 1, 6 and 7, the rearwardly projecting strap guiding wall 52, the transversely extending cable supporting walls 56 and 58 and the strap supporting wall 62 are disposed with respect to one another to define a strap receiving aperture 66 therebetween. The strap receiving aperture 66 defines a width "e" which is dimensioned to receive the strap 16 as explained further below. The aperture 66 is further defined by ridges 68 and 69 which extend toward one another a distance "f" from the transverse cable supporting walls 56 and 58 respectively. The distance "g" between the rearwardly projecting strap guiding wall 52 and the ridges 68, 69 is greater than the thickness of the strap 16 as explained herein. The uppermost portions of the ridges 68 and 69 are arcuate, as shown in FIG. 7, to facilitate the initial guiding of the strap 16 into position for achieving the strain relief mounting to the cables 20 extending from the backshell 10.

The strap receiving aperture 66 in the base 12 is further defined by a tie strap ratchet trigger 70 which is cantilevered from the side of the strap supporting wall 62 opposite the tie strap 16. More particularly, the ratchet trigger 70 is angularly aligned to the walls 52 and 62 at an angle "h" as shown in FIG. 7 of approximately 25°. However, the ratchet trigger 70 is deflectable relative to the strap supporting wall 62 from which it is cantilevered.

The side of the ratchet trigger 70 opposite the strap supporting wall 62 is formed to define a pair of spaced apart ratchet teeth 72 and 74. The distance "i" between the ratchet teeth 72 and 74 corresponds to the distance between the ratchet teeth on the tie strap 16 as explained further below. The length and angular alignment of the ratchet trigger 70 is such that a distance "j" exists between the ratchet teeth 72, 74 and the opposed surface of the rearwardly extending strap guiding wall 52. As will be noted further below, the distance "j" is selected to exceed the minimum thickness of the tie strap 16, such that deflection of the ratchet trigger 70 is caused by the movement of the tie strap 16 through the tie strap aperture 66.

The tie strap 16 is defined by a relatively thin flexible portion 76 generally adjacent the strap supporting wall 62, and a thicker portion defined by an array of ratchet teeth 78 spaced from the strap supporting wall 62. Each ratchet tooth 78 in the array is defined by a locking surface 80 extending generally orthogonal to the strap 16 and a ramp surface 82 angularly aligned to the longitudinal direction of the strap 16. The major thickness "k" defined by the portion of strap 16 on which the ratchet teeth 78 are disposed is greater than the distance "j" between the teeth 72, 74 of the ratchet trigger 70 and the opposed rearwardly projecting strap guiding wall 52. However, the distance "k" defining the major thickness of the strap 16 is less than the distance "g" between the strap guiding wall 52 and the ridges 68, 69. The minimum thickness "1" of the strap 16 as measured between adjacent ratchet teeth 78 preferably is slightly greater than the distance "j" between the strap guiding wall 52 and the ratchet teeth 72 and 74 of the ratchet trigger 70. Thus, the ratchet trigger 70 will be deflected away from the position shown in FIG. 7 toward the strap supporting wall 62 when the strap 16 is engaged in the strap receiving aperture 66. As a result, the ratchet trigger 70 will exert resilient forces back toward its initial unbiased condition to more securely lockingly retain the tie strap 16 against the strap guiding wall 52 of the strap receiving aperture 66.

The strap 16 has a width "m" as shown in FIG. 6, which is less than the width "e" of the strap receiving aperture 66. However, the width "m" of the tie strap 16 is greater than the distance between the ridges 68 and 69. Thus, the strap 16 will be positively retained intermediate the ridges 68, 69 and the rearwardly projecting strap guiding wall 52. This positive guiding of the tie strap 16 into the portion of the strap receiving aperture 66 between the ridges 68, 69 and the strap guiding wall 52 ensures that the tie strap 16 does not overeflect and thereby damage the ratchet trigger 70.

As shown in FIG. 1, the tie strap 16 is provided with a pair of longitudinally extending surfaces 84 and 86 disposed respectively on opposite sides of the ratchet teeth 78 and being substantially in line with the top of the ratchet teeth 78, as shown in FIGS. 1 and 7. The surfaces 84 and 86 on the tie strap 16 have a width "f" approximately equal to the amount of extension of the ridges 68 and 69 in the strap receiving aperture 66. Thus, the longitudinally extending surfaces 84 and 86 on the tie strap 16 ensure smooth entry of the tie strap 16 into the strap receiving aperture 66. More particularly, the longitudinal surfaces 84 and 86 on the tie strap 16 prevent contact between the ratchet teeth 78 and the nondeflectable ridges 68 and 69 in the strap receiving aperture 66.

Figure 5:
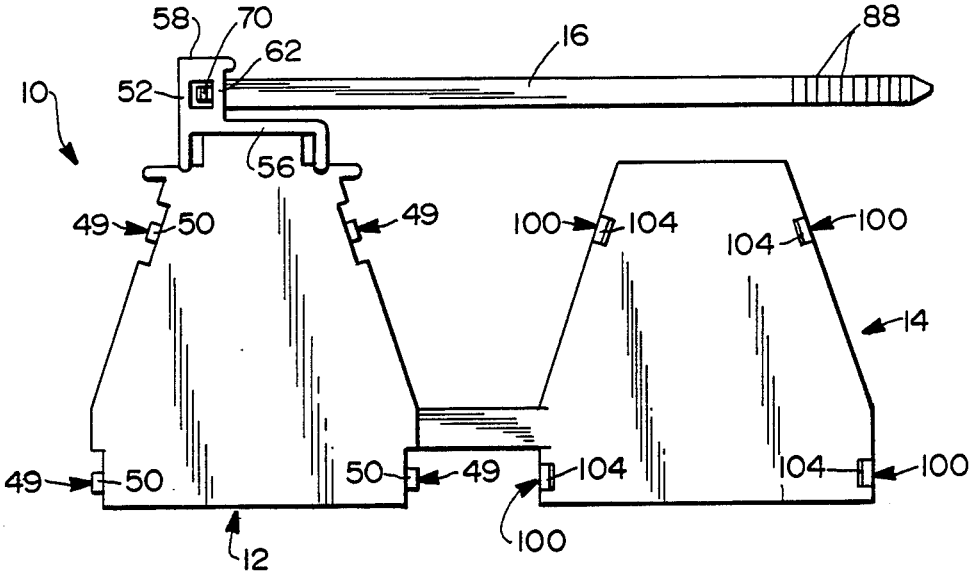
FIG. 5 is a bottom elevational view of the backshell in an opened condition.

With reference to FIGS. 1, 2 and 5, it will be noted that the extreme end of the strap 16 is provided with a serrated or roughened portion 88. These serrations are provided to facilitate either manual or mechanical gripping of the strap 16 for insertion into the strap receiving aperture 66.

The cover 14 is unitarily molded with the base 12 and is articulated thereto by unitary hinge 90. More particularly, the hinge 90 defines a thickness which permits the flexible rotational movement of the cover 14 relative to the base 12.

Figure 8:
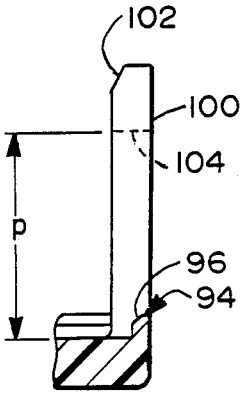
FIG. 8 is a cross-sectional view taken along line 8—8 in FIG. 1.

The cover 14 is configured and dimensioned to be placed in register with the base 12. In particular, the cover 14 includes a peripheral lip 94 as shown most clearly in FIG. 8. The peripheral lip 94 is disposed and dimensioned to be engaged in the rabbet groove 44 extending around the top of the base 12. The lip 94 is defined in part by a chamfered edge 96 which is mateable with the chamfer 46 adjacent the rabbet groove 44. The ramping interengagement of the chamfered surfaces 46 and 96 of the base 12 and cover 14 respectively guides the cover 14 into its fully seated position on the base 12.

The cover 14 is further provided with a plurality of latches 100 which are engageable respectively with the locking protrusions 49 on the base 12. More particularly, the latches 100 include inwardly facing ramped surfaces 102 which are initially engageable with the chamfer 46 adjacent the uppermost portions of the side walls 26, 28 and which subsequently are engageable with the ramped portions 50 of the locking protrusions 49. Each latch 100 is of generally U-shape configuration and defines a width "n" which is approximately equal to or slightly less than the width "c" of the locking recess 48 of the base 12.

The U-shaped configuration of the latch 100 defines an interiorly disposed locking surface 104 having a width approximately equal to the width of the corresponding locking protrusion 49. Furthermore, the locking surface 104 is spaced from the planar top wall 92 of the cover 14 by a distance "p" which is approximately equal to the distance "d" between the uppermost edge of the side walls 26, 28 and the locking surface 51 of the locking protrusion 49. As a result of this configuration, the locking surface 104 of each latch 100 can be snapped into locking engagement with the corresponding locking surfaces 51 of each locking protrusion 49. It will be appreciated that all of the latches 100 are disposed to lie in close engagement with the external portions of the side walls 26, 28 of the base 12. This external location of the latches 100 contributes to the support of the base 12, and prevents bowing of the side walls 26, 28 that could adversely affect the environmental protection of the connector 18.

The backshell 10 is employed with the electrical connector 18 having mounting ears 36 and 37 by urging the electrical connector 18 into the base 12 such that the mounting ears 36 and 37 thereof are engaged adjacent the walls 34 and 35 of the base 12. The cables 20 extending from the connector 18 are positioned in the channels 60 and 64 at the rearwardmost portions of the base 12. The tie strap 16 is then wrapped over the cables 20 and is inserted through the tie strap aperture 66 as shown in FIG. 2. More particularly, the tie strap 16 is guided into the portion of the tie strap aperture 66 by the ridges 68, 69 such that the ratchet teeth 78 of the tie strap 16 are urged into engagement with the ratchet trigger 70. The movement of the tie strap 16 through the tie strap aperture 66 causes the ratchet trigger 70 to be deflected toward supporting wall 62 by the camming action between the ratchet teeth 78 of tie strap 16 and the ratchet teeth 72, 74 of the trigger 70. However, overdeflection of the trigger 70 is prevented by the sliding interaction between longitudinal surfaces 84 and 86 of the tie strap 16 and the ridges 68 and 69 on the base 12. Reverse movement of the tie strap 16 is positively presented by the double engagement of the ratchet teeth 72 and 74 of the ratchet trigger 70 with a pair of locking surfaces 80 on adjacent ratchet teeth 78 of tie strap 16. In this locked position, the ratchet trigger 70 is biased away from its initial unloaded condition as shown in FIG. 7, and therefore exerts a strong biasing force against the tie strap 16 to urge the tie strap 16 against the strap supporting wall 52. Reverse movement or loosening of the tie strap 16 is positively prevented by the substantial forces generated by the angular cantilevered loaded condition of the relative trigger 70 relative to the tie strap 16.

The cover 14 is rotated about hinge 90 and into alignment with the base 12. Movement of the cover 14 and base 12 toward one another causes the latches 100 to deflect outwardly by virtue of the camming interaction of latch surfaces 102 first with the chamfer 46 adjacent the side walls 26, 28 of the base 12, and subsequently by virtue of the camming action between the latch surfaces 102 and the ramps 50 on the locking protrusions 49. Further movement of the cover 14 toward the base 12 will cause the locking surface 104 of each latch 100 to engage the corresponding locking surface 51 of each locking protrusion 49. Ramping action between the chamfered surfaces 96 on cover 14 and the chamfered surface 46 on the base 12 ensure proper environmentally protective engagement of the lip 94 of cover 14 to the rabbet groove 44 of base 12. In this fully closed position as shown in FIG. 3, the latches 100 are all disposed respectively on external portions of the side walls 26, 28 of base 12, and thereby prevent outward bowing of the side walls 26 and 28. Such outward bowing is further prevented by the external engagement of the lip 94 of cover 14 with the rabbet groove 44 of the base 12. This fully seated external engagement of the lip 94 with the rabbet groove 44 contributes substantially to the environmental protection of the connector 18. Additionally, the base 12 is substantially free of apertures, particularly in the vicinity of the locking protrusions 49, thereby further ensuring environmental protection.

In summary, an environmentally protected strain relief backshell is provided for commercially available electrical connectors. The backshell is of unitary molded construction and comprises a base, a cover hingedly connected to the base and a ratcheted tie strap which is engageable with a ratchet trigger on the base. The cover comprises latches and a peripheral lip that are engageable with locking protrusions and a rabbet groove respectively on the base. This interengagement of the base with the cover prevents outward bowing of the base side walls that could otherwise affect the environmental protection of the backshell. This construction further ensures that the locking protrusions of the base can be formed without providing apertures through the base that could also affect environmental protection. The unitarily molded ratcheted tie strap is engageable about the cables extending from a connector mounted in the base to ensure strain relief. The ratchet trigger unitary with the base is configured and angularly disposed to substantially prevent loosening of the tie strap relative to the cable.

While the invention has been described with respect to a preferred embodiment, it is apparent that various changes can be made without departing from the scope of the invention as defined by the appended claims.

We claim:

1. A unitarily molded backshell for receiving an electrical connector and at least one cable extending therefrom, said backshell comprising:

a base comprising a foward connector receiving portion and a rearward cable receiving portion;

a flexible strain relief tie strap extending unitarily from the rearward portion of said base, said tie strap being formed to define an array of ratchet teeth;

a rearwardly disposed strap guiding wall extending adjacent the cable receiving portion of said base;

a deflectable ratchet trigger cantilevered from said base and angularly aligned to said strap guiding wall, said ratchet trigger being spaced from said strap guiding wall by a distance generally corresponding to the thickness of the tie strap such that said ratchet trigger is lockingly engageable with said tie strap for retaining said tie strap intermediate the strap guiding wall and the ratchet trigger; and a cover hingedly connected to said base and rotatable into environmentally protective locked relationship to said base, whereby the connector can be environmentally protected in the backshell and whereby the tie strap achieves strain relief connection to the cable.

2. A backshell as in claim 1 wherein said cover and said base comprise interengageable lip and groove means for environmental protection around the connector.

3. A backshell as in claim 1 wherein the base comprises a base wall and side walls extending therefrom, the side walls of said base define a rabbet groove adjacent the externally disposed surfaces thereof most distant from said base wall, and wherein said cover defines a peripheral lip disposed and dimensioned to engage the rabbet groove of said side walls, whereby the engagement of said peripheral lip with said rabbet groove prevents bowing of the base side walls and contributes to environmental protection of the backshell.

4. A backshell as in claim 3 wherein said side walls of said base and said peripheral lip of said cover are chamfered to define opposed ramping surfaces for guiding said cover into proper seated relationship to said base.

5. A backshell as in claim 1 wherein said cover comprises a plurality of deflectable latches for locking engagement with said base.

6. A backshell as in claim 5 wherein said latches are disposed to engage external portions of said base.

7. A backshell as in claim 6 wherein said base comprises a plurality of locking protrusions extending unitarily therefrom, said latches being disposed and dimensioned to engage the locking protrusions of said base.

8. A backshell as in claim 7 wherein the deflectable latches and the locking protrusions are ramped to facilitate deflection of said latches prior to engagement of said latches with said locking protrusions.

9. A backshell as in claim 1 wherein said base comprises a unitarily formed rearwardly disposed strap supporting wall adjacent the cable receiving portions of said base, said tie strap and said ratchet trigger extending unitarily from opposed sides of said tie strap supporting wall.

10. A backshell as in claim 1 wherein said base comprises a pair of spaced apart cable supporting walls extending unitarily from said base, said cable supporting walls being spaced from one another by a distance equal to or slightly greater than the width of said tie strap.

11. A backshell as in claim 10 further comprising a pair of spaced apart strap guiding ridges extending toward one another from said spaced apart cable supporting walls, said ridges being spaced from said strap guiding wall by a distance equal to or slightly greater than the thickness of said tie strap.

12. A backshell as in claim 11 wherein said ratchet trigger is disposed intermediate said spaced strap guiding ridges and is deflectable relative thereto.

13. A backshell as in claim 12 wherein the distance between said strap guiding wall and said strap guiding ridges is greater than the distance between said strap guiding wall and said ratchet trigger in the undeflected condition of said ratchet trigger.

14. A backshell as in claim 13 wherein said ratchet trigger is angularly aligned to said strap guiding wall at an angle of approximately 25°.

15. A backshell as in claim 14 wherein the unitary connection of the base wall and the side walls of said base is substantially free of apertures extending therethrough.

16. A unitarily molded backshell for receiving an electrical connector and at least one cable extending therefrom, said backshell comprising:

a molded base comprising a base wall and a plurality of unitarily connected upstanding walls extending from and unitary with said base wall, at least selected ones of said upstanding walls comprising a groove formed therein at locations remote from said base wall, said base further defining a connector receiving portion and a cable receiving portion;

a cover hingedly connected to said base and rotatable into engagement with the upstanding side walls of said base, said cover comprising a peripheral lip for environmentally protective engagement with the groove of said upstanding side walls of said base;

a flexible strain relief ratcheted tie strap extending unitarily from said base adjacent the cable receiving portion thereof;

a plurality of walls unitary with said base and disposed in proximity to the cable receiving portion thereof, said plurality of walls being disposed relative to one another to define a strap receiving aperture therebetween; and a deflectable ratchet trigger unitary with said base and cantilevered into said strap receiving aperture, said ratchet trigger being dimensioned to lockingly engage the tie strap for achieving strain relief connection of said tie strap to said cable.

17. A backshell as in claim 16 wherein the groove of said upstanding walls defines a rabbet groove disposed adjacent external portions of said upstanding walls.

18. A backshell as in claim 17 wherein the upstanding walls of said base are chamfered adjacent the rabbet groove therein, and wherein the peripheral lip of said cover is chamfered for ramped guiding alignment of said cover into environmentally protective engagement with said base.

19. A backshell as in claim 16 wherein said upstanding side walls of said comprise a plurality of ramped locking protrusions extending outwardly from externally facing portions of said upstanding walls, and wherein said cover comprises a plurality of resiliently deflectable latches dimensioned for locking engagement with the externally disposed locking protrusions of said base, whereby the external engagement of said latches relative to said base prevents bowing of the upstanding walls of said base and contributes to environmental protection thereof.

* * * * *